US006536515B2

(12) United States Patent
Freitag et al.

(10) Patent No.: US 6,536,515 B2
(45) Date of Patent: Mar. 25, 2003

(54) EVAPORATOR FOIL STACK

(75) Inventors: Oliver Freitag, Kirchheim (DE); Alois Tischler, Aidenbach (DE)

(73) Assignee: Ballard Power Systems AG, Kirchheim/Teck-Nabern (DE)

( * ) Notice: Subject to any disclaimer, the term of this patent is extended or adjusted under 35 U.S.C. 154(b) by 0 days.

(21) Appl. No.: 09/810,526

(22) Filed: Mar. 19, 2001

(65) Prior Publication Data

US 2001/0045274 A1 Nov. 29, 2001

(30) Foreign Application Priority Data

Mar. 17, 2000 (DE) ..... 100 13 437

(51) Int. Cl.[7] ..... F28D 7/16; F28F 3/00
(52) U.S. Cl. ..... 165/166; 165/164; 165/165
(58) Field of Search ..... 165/165, 166, 165/167, 164

(56) References Cited

U.S. PATENT DOCUMENTS 4,347,896 A * 9/1982 Rosman et al. ..... 165/166
4,516,632 A * 5/1985 Swift et al. ..... 165/167
4,572,766 A * 2/1986 Dimitriou ..... 165/167 X
5,226,474 A 7/1993 Hallgren
5,392,849 A * 2/1995 Matsunaga et al. ..... 165/167
5,823,252 A 10/1998 Waitkat et al. ..... 165/166
5,829,517 A * 11/1998 Schmid et al. ..... 165/167
5,911,273 A * 6/1999 Brenner et al. ..... 165/167

FOREIGN PATENT DOCUMENTS

| | | | | |
|---|---|---|---|---|
| BE | 762960 | * | 8/1971 | ..... 165/167 |
| EP | 0460872 | | 12/1991 | |
| FR | 2496861 | | 6/1982 | |
| JP | 61243297 | | 10/1986 | |
| JP | 3-236594 | * | 10/1991 | ..... 165/167 |

* cited by examiner

*Primary Examiner*—Leonard Leo
(74) *Attorney, Agent, or Firm*—Crowell & Moring LLP

(57) ABSTRACT

An evaporator stack, in particular for a double evaporator, includes foils for converting a liquid medium into a gaseous medium. The foil stack has at least one foil through which a medium flows and at least one additional foil. The foil stack has an inlet region for the liquid medium and a discharge region for the gaseous medium. The discharge region is designed such that a pressure gradient in the medium over the at least approximately entire width of the discharge region is smaller than a pressure gradient in the medium over the at least approximately entire length of the media foil through which flow occurs.

7 Claims, 1 Drawing Sheet

EVAPORATOR FOIL STACK

BACKGROUND AND SUMMARY OF INVENTION

This application claims the priority of German application No. 100 13 437.8-44, filed Mar. 17, 2000, the disclosure of which is expressly incorporated by reference herein.

The present invention relates to a foil for an evaporator, in particular a double evaporator, composed of foils for converting a liquid media mass flow into a gaseous media mass flow.

A single evaporator composed of foils is disclosed in DE 44 26 692 C1. The two-stage evaporator unit converts a liquid reactant mass flow, which can be set as a function of a predetermined load, into a gaseous reactant mass flow. The liquid reactant mass flow is at least partly evaporated by a heat-transfer medium in a first stage, and is completely evaporated, if need be, in a second stage and then is superheated. In this case, it is proposed that the evaporator unit be formed by alternately stacking, one on top of the other, foils having heat-transfer channels and foils having reaction channels. In each case, at least a first stage and a second stage are integrated in a foil, the first stage being designed as a channel having a minimized cross-sectional area so as to directly adjoin an inflow line. The first stage is operated at high heat-transfer coefficients, and the overall cross section of the reaction channels increase in the second stage in the direction of flow.

In evaporators of such construction, the evaporated reactant mass flow will normally discharge from each of the reaction or media foils into a common collecting space in the discharge region and the gaseous reactant mass flow is drawn off via a discharge line. In this case, intermixing of the reactant mass flows flowing out of the respective reaction foils can occur in the collecting space arranged in the discharge region, so that there is a comparatively uniformly evaporated reactant mass flow at the outlet.

Nonetheless, such an evaporator unit has the disadvantage that it is not possible to reliably determine that region of the channels, made in the foil, in which the actual evaporation takes place. As a result, a uniform distribution of the reactant mass flow to be evaporated in each of the foils is adversely affected. Although this disadvantage can be partly removed by the above-described mixing in the collecting space, it would be desirable, for the efficiency and for the best possible power transmission in the evaporator unit, to obtain a uniform distribution in each of the foils. Reactant mass flows which are heated or evaporated in a very uneven manner are already superheated in sections of the evaporator, in which case there will still be liquid droplets in the reactant mass flow in other sections and possibly also in the outlet region. In the worst case, "cold channels", through which comparatively cold, possibly even liquid, portions of the reactant mass flow will pass through the evaporator unit, may therefore form.

The object of the present invention is to achieve an ideal and uniform distribution of the medium to be evaporated and of the evaporated medium, in particular in the discharge region of the foils of an evaporator composed of foils.

According to the present invention, because the pressure gradient in the medium is markedly smaller than the pressure gradient over the length of the media foil through which flow occurs, a very uniform distribution of the evaporated medium in the discharge region is achieved. Ultimately, this is also assisted in an especially advantageous manner by virtue of the fact that the discharge region can be heated.

Due to the uniform distribution of the medium over the entire area, in particular over the entire width of the discharge region—the uniform distribution being achieved by the considerably smaller pressure gradient there than the pressure gradient over the length through which flow occurs—it can be ensured that the medium in the discharge region is distributed very uniformly, and that no dead zones are produced in which there is no media flow or only a very slight media flow. A uniform flow and thus uniform utilization of the available energy also take place in that region of the media flow which is arranged directly upstream of the discharge region in the direction of flow, since "damming" in the region of the media foil cannot occur as a result of stationary medium collecting in the discharge region.

In addition, the discharge region is arranged in the heated area of the media foils, so that the discharge region performs more than the pure function of a collecting space, and the gaseous media portions, discharging over the width of the respective media foil, can be intermixed in the heated discharge region. Thus a very uniform distribution of the medium evaporating in the respective foil occurs before this medium leaves the foil to go into a collecting space, which then connects a plurality of such foils and a discharge line to one another.

Other objects, advantages and novel features of the present invention will become apparent from the following detailed description of the invention when considered in conjunction with the accompanying drawings.

DETAILED DESCRIPTION OF THE DRAWINGS

Figure 1:
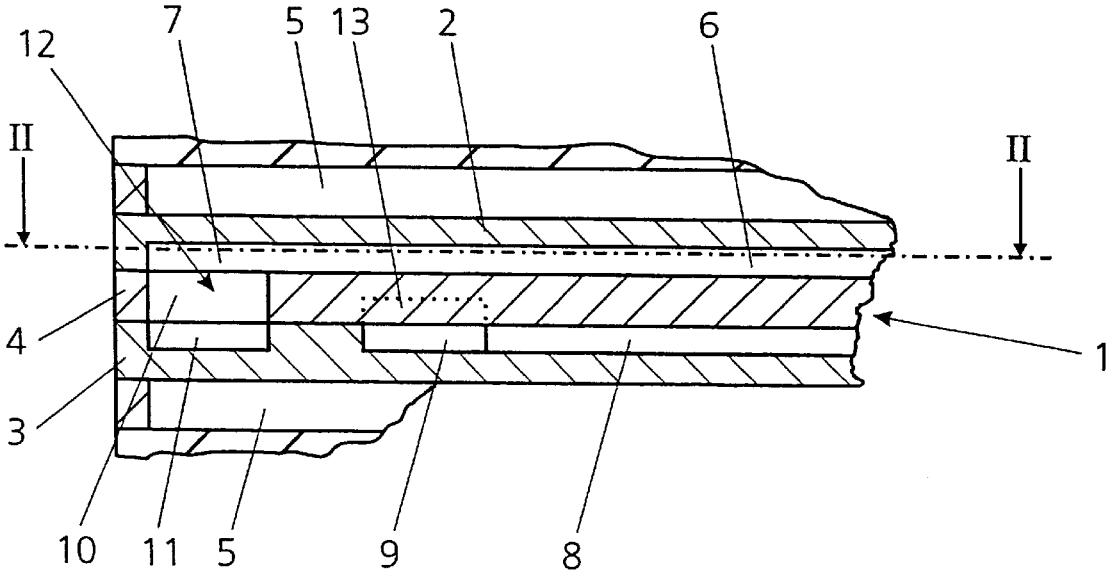
FIG. 1 shows a cross section through part of a double evaporator.

A foil stack 1 of an evaporator (not shown in its entirety) is shown in FIG. 1. The evaporator is of double construction. This means that the evaporator has at least two separate inlets for two media mass flows. Accordingly, each of the foil stacks 1 here has a first media foil 2 and a second media foil 3. An intermediate foil 4 is arranged here between the two media foils 2, 3. These three foils 2, 3, 4 are then combined to form the foil stack 1.

There are then further spaces 5 on at least two sides of the foil stack 1, in which a heating medium flows or the thermal energy for heating the foil stacks 1 is made available in some other way, for example, by catalytic combustion or the like. A conceivable construction, for example, would be for the foil stacks 1 and spaces 5 to be stacked alternately one above the other, as basically shown here.

The first media foil 2 has (1) an evaporation region 6, which serves to evaporate and/or superheat the first media flow; and (2) an outlet region 7 adjoining evaporation region 6 in the direction of flow of the media. The evaporation region 6 has structures, channels, passages or the like, which are not explicitly shown here, since they are known per se and are of secondary interest for the present invention. The outlet region 7 of the first media foil 2 may be free of such structures, but need not be.

A comparable construction is shown by the second media foil 3, which likewise has an evaporation region 8 and an outlet region 9.

In the area of the outlet region 7 of the first media foil 2, an opening 10 is arranged in the intermediate foil 4. This opening 10, and a recess 11 in the second media foil 3 result in a considerable cross-sectional enlargement in the area of the outlet region 7, compared with the evaporation region 6. This region of the cross-sectional enlargement, which in the exemplary embodiment shown here consists of the outlet region 7; the opening 10; and the recess 11, forms, in its entirety, a discharge region 12 for the media mass flow in the first media foil 2. Due to the cross-sectional enlargement, a much smaller pressure gradient will appear in the area of the discharge region 12 than is the case over the run length of the media flow in the evaporation region 6.

In the second media foil 3, the evaporation region 8 of which has a smaller run length than the evaporation region 6 of the first media foil 2, such an enlargement of the cross section in the area of the outlet region 9 is not desirable on account of technical conditions which do not affect the present invention. In principle, however, it would also be conceivable, for example by making a recess 13 (indicated by broken line) in the intermediate foil 4, to create an area comparable to the discharge region 12.

Figure 2:
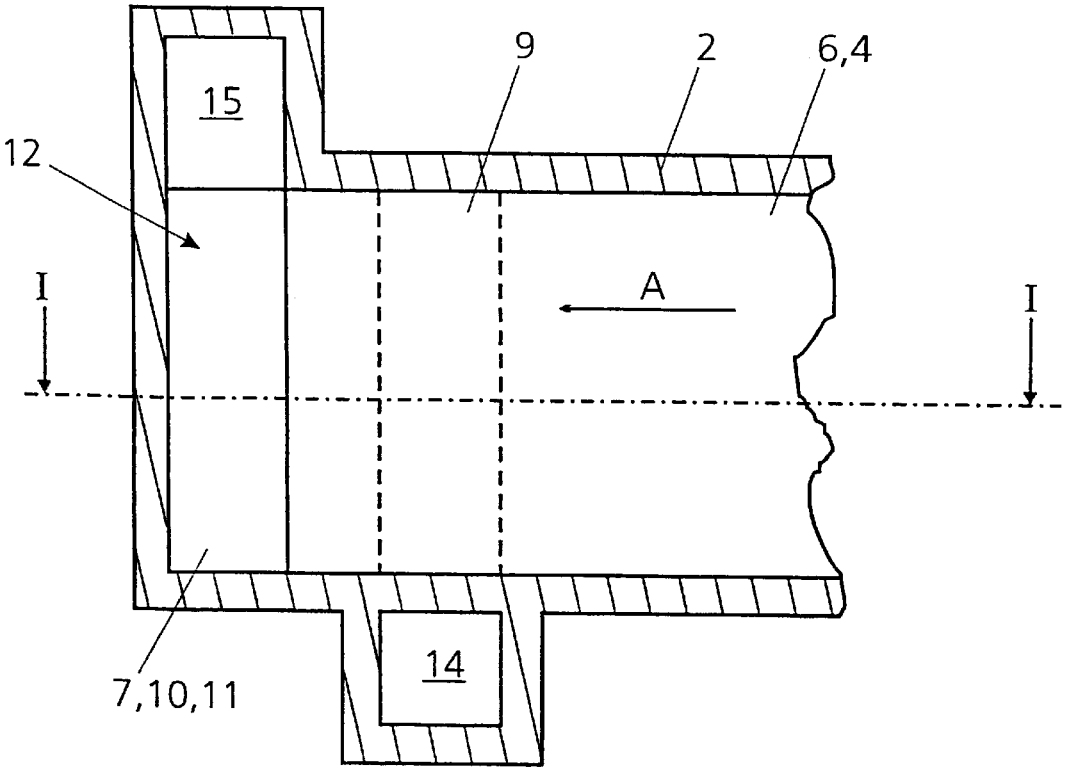
FIG. 2 shows a basic section along line II—II in FIG. 1.

A basic section through the first media foil 2 or a plan view of the intermediate foil 4 arranged underneath can now be seen in FIG. 2. In this case, the discharge region 9 of the second media foil 3 is indicated as a hidden detail. It opens into a collecting space 14 which corresponds with the second media foil 3, connects all the second media foils 3 of the foil stacks 1 to one another and corresponds with a discharge line (not shown) for the second media flow.

The evaporation region 6 through which the first media flow flows in accordance with the flow direction indicated by arrow A can be seen in the first media foil 2. The opening 10 and the recess 11 arranged underneath in the second media foil 3, that is the discharge region 12, can then be seen in the outlet region 7. This discharge region 12, increasing in its cross section, corresponds with a collecting space 15, which in turn is connected to a discharge line (not shown) for the first media flow.

The discharge region 12 runs over the entire width of the evaporation region 6 of the first media foil 2, so that the greatly reduced pressure gradient can appear over the entire width of the foil stack 1. In this way, it is possible to achieve a very low pressure loss and thus a very uniform distribution of the medium flowing out of the evaporation region 6 in this discharge region 12.

In addition, due to the good uniform distribution, "damming" of the flow in the evaporator region 6 is prevented, which "damming" could otherwise occur, in particular, at that end of the discharge region 12 or of the evaporation region 6 which is remote from the collecting space 15. The entire area of the evaporation region 6 can thus be used for the task as prescribed, namely the conversion of the liquid media mass flow into the gaseous media mass flow, which ultimately makes possible better power transmission per unit of area and which in turn can lead to a smaller overall space for the evaporator. Increased material stresses due to a very high temperature gradient in the region of stationary media in the foil stack 1 can also be prevented or at least reduced.

Because the area in the discharge region 12 is arranged in the foil stack 1 in such a way that it is in direct heat-conducting contact with the spaces 5 for heating, just like the evaporation regions 6, 8 and the outlet region 9, this achieves the effect that the discharge region 12 is heated throughout, which likewise prevents the formation of "cold" dead zones of the media mass flow and greatly improves the uniform distribution and intermixing of the media mass flow before entering the collecting space 15.

Of course, other types of construction of a foil stack 1 which would achieve the same effect, or at least a very similar effect, are also possible. For example, corresponding recesses could merely be made in the intermediate foil in the area of the outlet regions 7, 9, and an opening 10 in the intermediate foil 4 could be dispensed with, so that an identical run length of the media mass flows in the two media foils 2, 3 would also be perfectly conceivable.

The foils 2, 3, 4 used may be, for example, thin plates or foils made of a high-alloy steel material into which the recesses 11 and the structures in the evaporation regions 6, 8 are etched.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An evaporator foil stack, comprising:

(a) at least a first media foil having an evaporator region and an outlet region;

(b) at least a second media foil having an evaporator region, an outlet region, and a recess; and (c) an intermediate foil between the first and the second media foils, said intermediate foil having an opening in the outlet region of the first media foil and the recess in the second media foil, thereby forming a discharge region for a gaseous medium from the evaporator region of the at least first media foil, wherein a cross section through which flow occurs is larger over an entire width of the discharge region than over a length of the at least first and second media foils, and wherein the discharge region is arranged in a heated area of the foil stack.

2. An evaporator foil stack according to claim 1, wherein a length of the evaporator region of the second media foil is less than a length of the evaporator region of the first media foil.

3. An evaporator foil stack according to claim 1, further comprising a collecting space for the gaseous medium from the discharge region.

4. An evaporator foil stack according to claim 1, further comprising a discharge region for a gaseous medium from the outlet region of the at least second media foil.

5. An evaporator stack according to claim 4, further comprising a collecting space for the gaseous medium from the outlet region of the at least second media foil.

6. An evaporator stack according to claim 1, further comprising spaces on at least two sides of the stack through which a heating medium flows.

7. An evaporator stack according to claim 6, wherein the discharge region is in heat-conducting contact with a space on at least one side of the stack through which the heating medium flows.

* * * * *